US009346589B2

(12) United States Patent
Bunton

(10) Patent No.: US 9,346,589 B2
(45) Date of Patent: May 24, 2016

(54) EASY CARRY FREEZER BAG

(71) Applicant: Pam Bunton, Merrillville, IN (US)

(72) Inventor: Pam Bunton, Merrillville, IN (US)

( * ) Notice: Subject to any disclaimer, the term of this patent is extended or adjusted under 35 U.S.C. 154(b) by 0 days.

(21) Appl. No.: 14/260,749

(22) Filed: Apr. 24, 2014

(65) Prior Publication Data

US 2015/0093050 A1 Apr. 2, 2015

Related U.S. Application Data

(60) Provisional application No. 61/885,180, filed on Oct. 1, 2013.

(51) Int. Cl.

| | |
|---|---|
| ***B65D 33/08*** | (2006.01) |
| ***B65D 33/00*** | (2006.01) |
| ***B65D 33/25*** | (2006.01) |
| ***B65D 77/22*** | (2006.01) |

(52) U.S. Cl.

CPC ..... *B65D 33/08* (2013.01); *B65D 33/004* (2013.01); *B65D 33/2591* (2013.01); *B65D 77/225* (2013.01)

(58) Field of Classification Search

USPC ..... 383/7, 100

See application file for complete search history.

(56) References Cited

U.S. PATENT DOCUMENTS

| | | | | |
|---|---|---|---|---|
| 3,247,957 | A * | 4/1966 | Kemble | 206/440 |
| 4,615,045 | A | 9/1986 | Siegel | |
| 4,715,728 | A * | 12/1987 | Sfikas | 383/9 |
| 5,480,230 | A | 1/1996 | May | |
| 5,853,247 | A * | 12/1998 | Shroyer | 383/95 |
| 6,361,209 | B1 | 3/2002 | LaRue et al. | |
| 6,712,510 | B2 | 3/2004 | Schneider et al. | |
| 7,988,359 | B1 | 8/2011 | Sussman et al. | |
| 8,251,881 | B2 * | 8/2012 | Chertkow et al. | 493/189 |
| 2003/0037519 | A1 * | 2/2003 | Ishizaki | 55/374 |

FOREIGN PATENT DOCUMENTS

WO WO 2006107975 A2 * 10/2006

* cited by examiner

*Primary Examiner* — Christopher Demeree

(74) *Attorney, Agent, or Firm* — Daniel Boudwin; Global Intellectual Property Agency, LLC

(57) ABSTRACT

Disclosed is a resealable bag having a gusseted structure with a flared double-flapped upper panel wherein a handle and hang-up notch is incorporated therein. A one-way release valve is disposed on the bag to allow the ejection of air from the bag interior when the bag is exteriorly compressed. The flared upper panels can be folded in a downward position when loading foodstuffs. The bag structure comprises a back panel, a front panel, a floor panel, and a double-flapped upper panel forming the handle. The exterior of the bag further provides a writing surface affixed thereto. The bag structure can be sealed via an interlocking closure means along its open upper. Finally, the bag material is one that is suitable for use in a freezer or cooking environment, wherein the bag can be taken from cold storage and heated without material degradation or food contamination.

11 Claims, 2 Drawing Sheets

EASY CARRY FREEZER BAG

CROSS REFERENCE TO RELATED APPLICATION

This application claims the benefit of U.S. Provisional Application No. 61/885,180 filed on Oct. 1, 2013. The above identified patent application is herein incorporated by reference in its entirety to provide continuity of disclosure.

BACKGROUND OF THE INVENTION

1. Field of the Invention

The present invention relates to sealable plastic bags. More specifically, the present invention pertains to a resealable plastic freezer bag with a handle, writing surface and a one-way purge valve for the ejection of air from inside of the bag.

Conventional methods of transporting and storing food involve the use of bags with zipper closure means that break easily and do not provide a sturdy bag interior for the storage of heavy foodstuffs. Such bags do not provide a handle and can be difficult to transport and open after remaining in the freezer for a long period of time. The zippers of these bags often break as a result of attempting to open the bag using the small provided space to place one's fingers thereon in order to adequately grip the bag. Moreover, it can be quite difficult to determine the contents of a bag after it has been placed in the freezer for a prolonged period of time.

More practical classes of bags provide for a handle, a gusseted structure and a flap that can fold downward so as not to contaminate the exterior surface of the bag while loading messy and bacteria-ridden food products. This gusseted structure can retain large and heavy food items while enabling the bag to be placed in an upright position. Still, such bags only provide one flap wherein the handle is contained and thus do not provide a strong handle means when carrying large loads.

Other bags can be used to store objects rather than food items in which a hang-up notch is incorporated. In this manner, these bags can be carried to school, a workplace or given to another and stored in a hanging fashion. A tangible writing surface to label the contents of the bag or name a person thereof is not provided although conducive to such a bag function.

Accordingly, the present invention relates to a new and improved resealable freezer and storage bag incorporating a handle, hang-up notch, flared foldable flaps, double closure zipper, one-way purge valve and a writing surface. Specifically, the present invention provides a flared double-flapped top panel wherein the handles and hang-up notch are centrally contained. The invention also provides a tangible writing surface maintained on the exterior surface of the bag thereon. Moreover, a one-way valve is disposed on the bag for purging air trapped within the bag interior volume, which is critical to prevent contamination over long storage periods and to reduce the overall cross section of the bag.

2. Description of the Prior Art

Devices have been disclosed in the prior art that relate to resealable bags. These include devices that have been patented and published in patent application publications. These devices generally relate to resealable plastic bags having a gusseted structure with handles and zipper closure means as well as hang-up capability. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 7,988,359 to Sussman describes a plastic bag that is comprised of a back panel, a front panel, an upper panel having an upper panel body and a flap and a floor panel. An interlocking zipper closure means is provided to seal the central opening that includes a first track and a second track that interlocks and unlocks with one another via a zipper sliding mechanism. The bag contains two handles that are independently attached to the bag on the same side of the opening wherein the handle portion of the bag folds away from the opening of the bag and behind the back panel as not to soil the bag during the placement of food therein. Although the Sussman device provides a helpful plastic bag structure, it provides limited usage in the way of food storage and preservation. The present invention offers a resealable storage bag having a purge valve and material designed for use in both a freezer and in hot cooking environments.

U.S. Pat. No. 6,361,209 to LaRue discloses a gusseted bag having a handle and a resealable slider closure means. The gusseted property of the bag allows the bag to stand in an upright position rather than lay flat. The closure means can be of a zipper nature and allows for the removal and insertion of contents at varying instances. While the resealable closure means and gusseted property provides a useful function in the way of bag utility, the present invention allows for a gusseted bag structure with a notched hang-up handle to provide for further storage positions.

U.S. Pat. No. 4,615,045 to Siegel provides a hang-up bag made from plastic material with pull flanges and fastener strip closure means. The device contains a hang-up header extension and a rupturable pilfer proof tongue attached to and along both of the pull flanges. This device however does not provide for optimal food storage and transportation accoutrements.

U.S. Pat. No. 6,712,510 to Schneider allows for a reclosable package in bag form accomplished by a zipper closure means. The zipper closure means provides a useful function wherein the zipper slider is able to move over the side seal thus resting adjacent to the cavity of the package. The device further provides a hang-up notch, however the device is lacking a handle space. The present invention provides an expansive handle area with a centrally located hang-up notch in said handle portion.

U.S. Pat. No. 5,480,230 to May describes a package having a tear bead, reclosable zipper, hang hole and a double header. The device allows graphic and textual information to be printed on the package. Nonetheless, this device lacks a suitable writing surface incorporated thereto and a handle portion. The present invention provides a package with a writing surface attached thereto and a resealable closure means.

U.S. Patent Publication No. 2006/0188177 to Dyer describes a resealable plastic bag with zipper closure means and die cut handles. A tear bead is included to prevent tampering with the contents enclosed therein in which the opening of the bag will be apparent. This device, while helpful in the field of consumer packaging applications, is not helpful for accomplishing the methods associated with at home food storage and handling practices.

U.S. Patent Publication No. 2006/0204148 to Kohn relates to an opaque plastic bag with a cutout handle, hang slit, closure means and an openable bottom portion. This bag is constructed to be used with prescription drugs and other small objects. The present invention provides an air purge valve located in the handle portion, a double closure zipper and double-flapped flared panels that can be turned downward to facilitate insertion of food items therein.

These prior art devices have several drawbacks. The above discussed bag devices do not provide for a resealable, gusseted bag structure consisting of a tangible writing surface thereon, a plastic material that can be utilized in both a freezer and in hot cooking environments, a double-flapped flared panel wherein a handle, one-way purge valve for evacuating air contents of the bag interior, and a hang-up notch that is incorporated into the handles thereof.

It is submitted that the present invention substantially diverges in design elements from the prior art, and consequently it is clear that there is a need in the art for an improvement to existing resealable plastic bag devices. In this regard the instant invention substantially fulfills these needs.

SUMMARY OF THE INVENTION

In view of the foregoing disadvantages inherent in the known types of resealable bag structures now present in the prior art, the present invention provides a new resealable bag apparatus wherein the same can be utilized for providing convenience for the user when transferring the bag from a freezer and into a cooking environment, labeling and transporting the contents of the bag, loading heavy foodstuffs and other items therein and releasing the air therein in order to properly store such foodstuff and items.

It is therefore an object of the present invention to provide a new and improved bag device that has all of the advantages of the prior art and none of the disadvantages.

It is another object of the present invention to provide a bag structure that is resealable.

Another object of the present invention is to provide a bag structure that is microwaveable, suitable for placement in boiling water or an oven environment, and is suitable for being used in a freezer for long-term storage of its contents.

Another object of the present invention is to provide a bag structure that can be directly transferred from a freezer into a cooking environment.

Another object of the present invention is to provide a bag structure that can be carried by way of a handle.

Another object of the present invention is to provide a gusseted bag structure that can be expanded and self-supporting on a countertop surface.

Another object of the present invention is to provide a bag structure with a one-way air purge valve, whereby air and steam can be evacuated from the bag interior volume when the bag is exteriorly compressed.

Yet another object of the present invention is to provide a bag structure with a writing surface thereon for identifying the bag contents after a prolonged period of storage.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
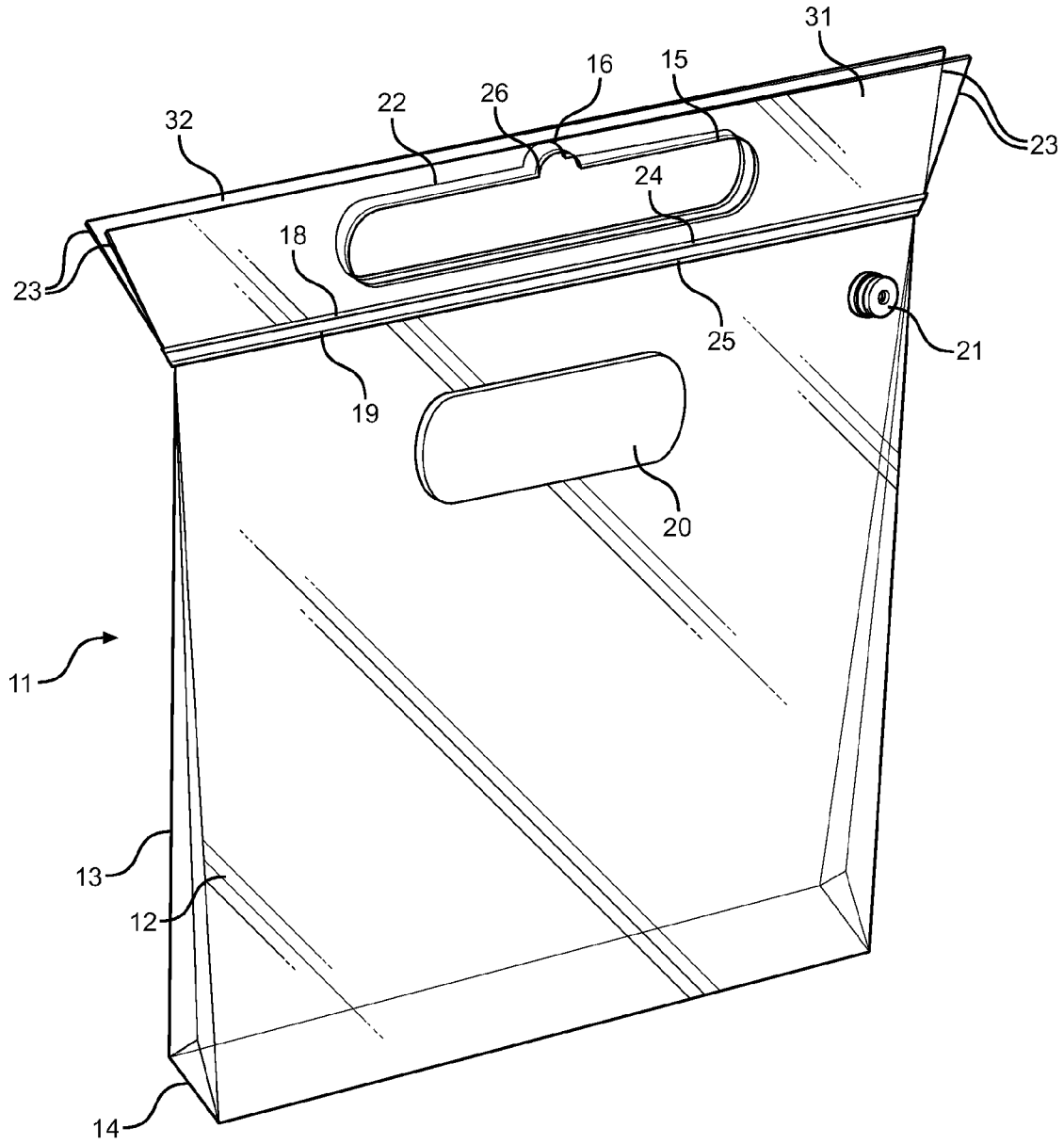
FIG. 1 shows a perspective view of the plastic bag structure in a gusseted embodiment wherein the handle, double zipper closure, hang-up notch, one-way air valve, and writing surface are shown.

Reference is made herein to the attached drawings. Like reference numerals are used throughout the drawings to depict like or similar elements of the plastic bag. For the purposes of presenting a brief and clear description of the present invention, the preferred embodiment will be discussed as used for storing foodstuffs or other objects within the bag interior wherein the plastic bag provides a one-way valve for the ejection of air and steam therefrom and for providing a handle structure for easily supporting the bag. The figures are intended for representative purposes only and should not be considered to be limiting in any respect.

Referring now to FIG. 1, there is shown a front view of the plastic bag structure. The plastic bag structure 11 comprises a front panel 12 having a top and bottom, a back panel 13 having a top and bottom, a floor panel 14 preferably having a gusseted surface. The front panel 12, back panel 13, and floor panel 14 form a bag having an enclosed interior volume with an open upper. Disposed along said open upper is a first upper panel 31 having a top and bottom and a handle opening 15, as well as a second upper panel 32 having a top and bottom and a handle opening 22. The upper panels 31, 32 are complimentary pairs, forming a double-handled support for the bag and its contents. The handle opening 15, 22 of the first and second upper panel 31, 31 forms a handhold for hand carrying the plastic bag structure 11 with one hand.

The outer edges 23 of the first and second upper panel 31,32 comprise a flared structure 23 wherein the outer edges 23 thereof are disconnected from each other end and as such are independent of one another. The flared outer edges 23 of the first and second upper panel 31, 32 are designed as such to permit the downward folding of the first and second upper panel 31, 32 away from the open upper of the bag for the loading of foodstuffs and other items therein. The outer edges of the front panel 12 and back panel 13 are furthermore adapted to be directly connected (not shown) or connected via an intermediate gusseted surface (shown in FIGS. 1-3). The material of the plastic bag structure 11 is one that is adapted to have a high melting point and one that can also withstand the cold temperatures of a freezer environment. It is contemplated that the bag may be used to store items in a freezer for a period of time and thereafter removed and placed in directly into a cooking environment. The cooking environment may include a microwave oven, a baking oven, or being submersed within boiling water.

The handle 15, 22 of the first and second upper panel 31, 32 provides a centrally located hang-up notch 16, 26 located along the top length thereof, wherein the hang-up notch 16, 26 is formed as part of the handle 15, 22. The first upper panel 31 contains a first handle opening 15 with a hang-up notch 26 and the second upper panel 32 contains a second handle opening 22 with hang-up notch 16, thereby providing the user with a sturdy handle structure that can support the weight of heavy foodstuffs and other items therein. The hang-up notch 16, 26 can be hung on a nail, hook or other support structure and will not readily fail under heavy loading, because of the increased strength of the double upper panels provided for hanging the assembly.

A resealable closure is disposed along the open upper, or mouth of the bag, and extends across the mouth. The resealable closure is provided to tightly seal the mouth opening after loading the bag interior with foodstuffs or other items therein. The resealable closure mechanism is embodied as one of the well-known zipper closure mechanisms in the art of plastic food storage bags. In a preferred embodiment, a double zipper closure 18, 24, 25, 19 is provided, wherein the double zipper closure 18, 24, 25, 19 has a first track 18, a second track 24, a third track 19, and a fourth track 25. The first track 18 interlocks with the second track 24 and the third track 19 interlocks with the fourth track 25. When the tracks are locked 18, 24, 25, 18, the central opening of the bag known as the mouth of the bag or open upper is sealed. This provides a first and second line of connection along the mouth of the bag to ensure an air tight seal of the bag interior volume.

Figure 3:
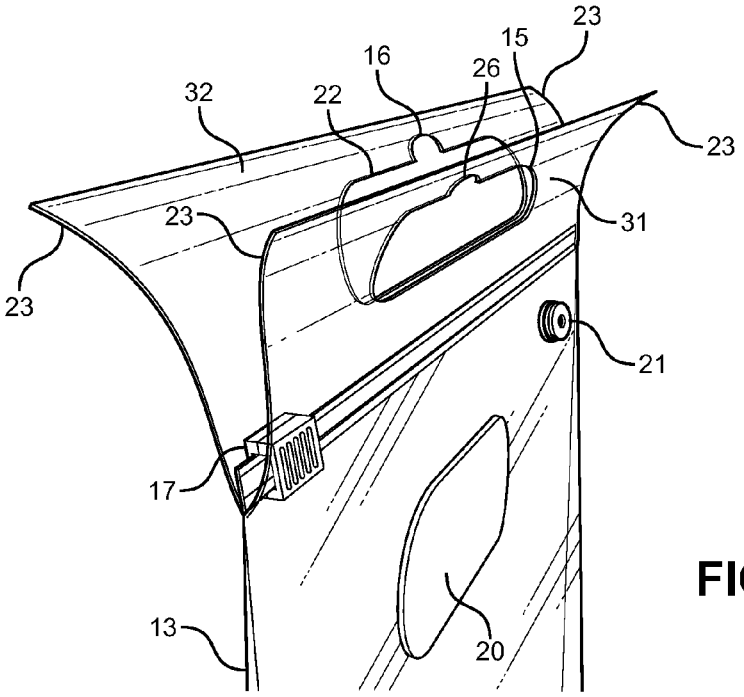
FIG. 3 shows a detailed view of the bag with a view of the writing surface, double zipper closure, one-way air valve, handle, hang-up notch, and the first and second upper panels wherein the panels are pulled away from one another.

The term "double zipper" is meant as having at least two zippered lines of connection that run parallel with one another across the mouth of the bag, wherein the zipping operation to open or close the zippers may be accomplished with a connection mechanism over a single passage thereof. The connection mechanism may comprise the user's fingers compressing the zippered lines of connection together, or may alternatively comprise a slider 17 as shown in FIG. 3, which can move across the double zipper 18, 24, 25, 19 from one of the side edges to the other of the side edges to seal and unseal the open upper. The double zipper is openable and reclosable and allows for the opening and closing and sealing of the bag across the mouth in order to secure the contents of the bag interior therein.

The interlocking closure can be one of a variety of closure mechanisms. The closure means can be a single zipper closure means that comprises a first track 18 and a second track 24 that interlocks with the first track 18. The closure means may also be slider-free, having opposite interlocking or mating elements that under the application of manual pressure will interlock and close the central mouth opening of the bag.

A writing surface 20 is provided on the exterior plastic bag surface and in a preferred embodiment, can be disposed on the first panel 12 and can be located beneath the interlocking closure mechanism. The "writing surface" 20 is adapted to be written on by various writing implements to include, but not limited to, a pen, pencil, marker, or crayon. The writing surface 20 is preferably heat sealed to the first panel 21, but could also be stitched, adhered or fastened to the exterior bag surface by other fastening and/or adhesive means.

A one-way air purge valve 21 is also provided along one or more of the bag panels for providing a plastic bag that permits the ejection and exhaustion of air from the bag interior, while also preventing entry of air into the bag from the exterior therethrough. The purge valve is a one-way air valve 21 that may comprise a ball valve, twist lock valve, degassing valve, or ball check valve, wherein the one-way air valves allow the outward flow of air and restrict the inward flow of air therethrough. It is submitted that the design of one-way valves of these types are well understood in the art. When the plastic bag structure 11 is closed and thus the interlocking elements of the open upper are sealed, air can be ejected from the bag using outside pressure applied to the exterior bag surface. The one-way air valve 21 is not limited to the aforementioned valves and any one-way valve suitable for the evacuation of air and steam upon the application of externally applied and manual pressure, which does not permit the reentry of air from the exterior environment, is deemed be suitable and an equivalent to those described above.

Referring now to FIG. 3, there is shown another view of the bag structure 11 of the present invention. The first upper panel 31 and the second upper panel 32 have a flared structure 23 whereby "flared" is meant as gradually becoming wider at one end. The first upper panel 31 and the second upper panel 32 can be pulled away from one another and thus folded in a downward position as such where the exterior surface of the first upper panel 31 can rest against the exterior surface of the front panel 12 thereagainst. Similarly, the second upper panel 32 can be pulled away from the first upper panel 31 and can be folded downward in such a manner as such where the exterior surface of the second upper panel 32 can rest against the exterior surface of the back panel 13 thereagainst.

The one-way air ejection valve 21 can be located on any part of the bag exterior surface and in a preferred embodiment is located on the upper corner exterior surface of the front panel 12. The one-way air valve 21 has a top end and a base end wherein the top end of the valve 21 extrudes from the exterior surface of the front panel 12 of the bag and the base end extends through the front panel 12 and thus terminates in the interior bag area thus facilitating the air flow from the bag interior outwardly through the valve 21 and is ejected from the top end into the surrounding environment. In a preferred embodiment, the one-way air valve 21 can be a twist lock valve as shown, wherein the user can manually twist the valve to an open position after the bag has been loaded with foodstuffs, sealed via the double zipper 18, 24, 19, 25 to which the bag exterior is then externally compressed until the air of the bag interior is ejected therefrom and the twist lock subsequently twisted to a locked position to prevent air from reentering the bag interior.

Figure 2:
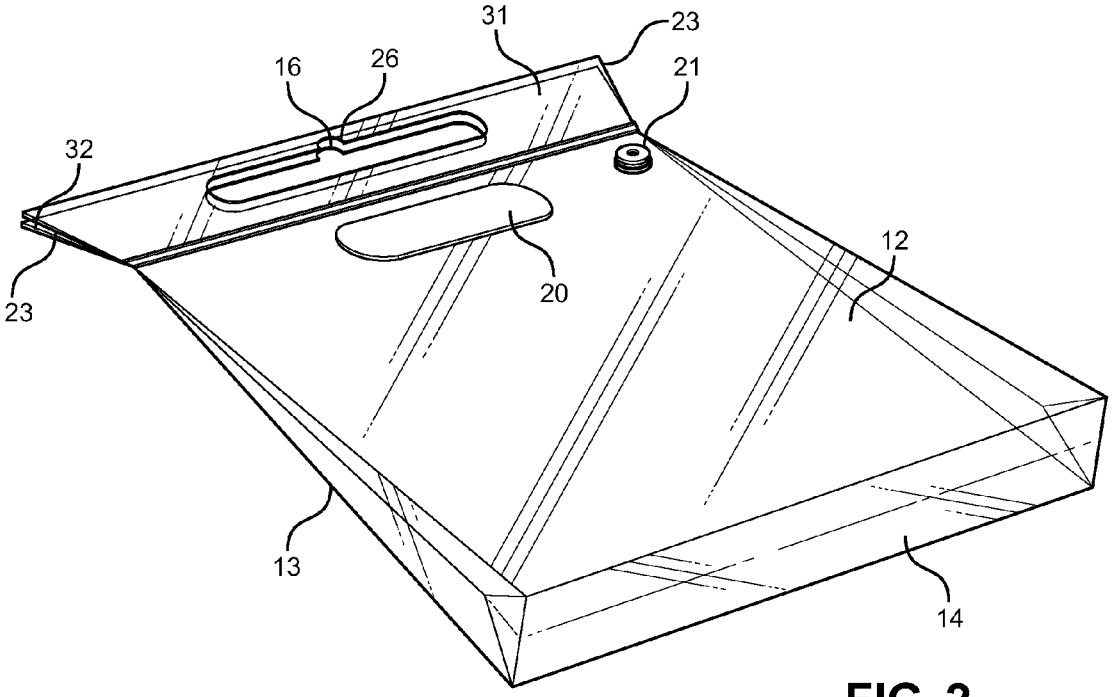
FIG. 2 shows a view of the bag in a flat orientation wherein the slider, writing surface, double zipper closure, handle, hang-up notch, and one-way air valve are visible.

Referring now to FIG. 2, there is shown a view of the bag 11 in a flat configuration. The front panel 12, back panel 13 and floor panel 14 can be folded in such a position as to lie in a flat position on a surface thereon. The floor panel 14 is preferably heat sealed to the front panel 12 and the back panel 13 at the bottom and thus connects the front and back panels 12, 13. The floor panel 14 preferably a gusset, can stand upright on a flat surface and forms the bottom floor of the bag structure 11. The front panel 12 can be preferable heat sealed to the back panel 13 wherein the first and second upper panels 31, 32 can be preferably heat sealed to the top of the front and back panels 12, 13. When the first and second upper panels 31, 32 are folded downward and thus away from the mouth of the bag, the user can manually push the slider 17 as shown in FIG. 3 from a closed position at one side edge of the bag to an open position at the other side edge of the bag wherein the slider 17 is located therebetween the first upper panel 31 and the second upper panel 32, in order to load the bag interior with foodstuffs and/or other items therein, whereby the sealing and unsealing of the mouth of the bag is accomplished by the double zipper closure 18, 24, 25, 19.

The writing surface 20 can be flat as shown and flexible wherein the writing surface 20 can be various shapes and sizes and can be located on various parts of the bag and is not limited to the placement on the front panel 12 thereto. The writing surface 20 can be written upon before or after placement of the bag 11 into a freezer or a cooking environment. The writing surface 20 is freezable and adapted to retain its markings when heated, whereby the writing disposed on the surface thereto will not fade or blur.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plastic bag structure, comprising:

a back panel, said back panel having a top and bottom;

a front panel, said front panel having a top and bottom;

a floor panel connecting to said front panel and said back panel at the bottom of said front and back panel to form a bag floor;

said front panel, said back panel, and said floor panel forming an enclosed interior volume with an open upper;

said front panel having a one-way air valve for ejecting air from said interior volume;

a writing surface on said front panel adapted to be written upon by a writing implement, the writing surface further adapted to retain its ability to be written upon and retain markings that have been made upon it subsequent to exposure to a freezer or cooking environment;

a first upper panel comprising a top and bottom;

said top of said first upper panel comprising a handle opening having a top edge and a bottom edge;

said first upper panel having a flared structure;

a hang-up notch along said top edge of said first handle opening;

a second upper panel comprising a top and bottom;

said top of said second upper panel comprising a handle opening;

said second upper panel having a flared structure;

a hang-up notch along said top edge of said second handle opening;

an interlocking closure along said open upper extending across said open upper between said first upper panel and said second upper panel.

2. The bag structure of claim 1, wherein said one-way air valve comprises a check valve that opens when said plastic bag structure surface is externally compressed and closed when said plastic bag structure is not being externally compressed wherein said valve does not permit air to enter into said interior volume.

3. The bag structure of claim 1, wherein said one-way air valve comprises a twist valve that is operably opened when twisted into an open position and closed when said twist valve is twisted into a closed position, wherein said closed position does not permit air into said interior volume.

4. The bag structure of claim 1, wherein said one-way air valve comprises a one-way degassing valve that permits air to exit from said interior volume.

5. The bag structure of claim 1 wherein said plastic bag structure is compatible with high heat cooking environments.

6. The bag structure of claim 1 wherein said plastic bag structure is freezer compatible.

7. The bag structure of claim 1 wherein said interlocking closure comprising a first track, a second track, a third track and a fourth track, and wherein said interlocking closure is a double zipper.

8. The bag structure of claim 1, wherein said interlocking closure further comprises a slider disposed for movement along said zipper between a zipper fully open position when said slider is at first side and a zipper fully closed position when said slider is at second side.

9. The bag structure of claim 1, wherein said front panel and said back panel comprise connected side edges.

10. The bag structure of claim 1, wherein said front panel and said back panel comprise first and second sides, said first and second sides being connected by a gusseted surface.

11. The bag structure of claim 1, wherein said floor panel comprises a gusseted surface.

* * * * *